US011162755B1

(12) United States Patent
Major

(10) Patent No.: US 11,162,755 B1
(45) Date of Patent: Nov. 2, 2021

(54) ARCHERY RELEASE

(71) Applicant: BERRY MTN., INC., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 16/935,870

(22) Filed: Jul. 22, 2020

Related U.S. Application Data

(60) Provisional application No. 62/876,810, filed on Jul. 22, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 3,845,752 A * 11/1974 Barner ..... F41B 5/1469 124/35.2
4,009,703 A * 3/1977 Cunningham, Sr. .. F41B 5/1469 124/35.2
4,066,060 A * 1/1978 Napier ..... F41B 5/1469 124/35.2
5,765,536 A * 6/1998 Scott ..... F41B 5/1469 124/35.2
8,997,729 B1 * 4/2015 Gillig ..... F41B 5/1469 124/35.2

* cited by examiner

*Primary Examiner* — John A Ricci
(74) *Attorney, Agent, or Firm* — Hooker & Habib, P.C.

(57) ABSTRACT

An index-finger-type archery release includes a release head, a hook pivotally mounted to a front end of the release head, and a trigger holder also pivotally mounted to the body that engages and resists pivotal movement of the hook while drawing a bowstring. A trigger attached to the body extends from the release head and is pulled by the archer, causing the trigger holder to pivot away from the hook and enabling the hook to pivot and release the bowstring. After release, the archer manually pivots the hook back to its starting position. A snap action of the trigger holder signals the archer that the archery release is again ready to draw a bowstring.

16 Claims, 8 Drawing Sheets

ARCHERY RELEASE

RELATED APPLICATION

This application claims the benefit of and priority to U.S. Patent Application Ser. No. 62/838,352 "Archery Release" filed Jul. 22, 2019.

FIELD OF THE DISCLOSURE

The disclosure relates to an archery release used for releasing an arrow from a bowstring, and in particular to an index-finger-type archery release.

BACKGROUND OF THE DISCLOSURE

Archery releases have a release head that holds a pawl or hook to hold a bowstring while an archer is pulling on the release head to draw the bowstring. In drawing the bowstring the archery release can pull directly on the bowstring or on a D-loop attached to the bowstring. The archery release enables the archer to smoothly and consistently draw the bowstring and release the bowstring for consistent and repeatable arrow flight.

An index-finger-type archery release has a trigger extending from the release head that is operatively connected to the hook. The archer pulls on the trigger using the archer's index finger, displacing the hook and releasing the bowstring from the hook.

Although there are many index-finger-type archery releases, there is always room for improvement in the construction, operation, and operative feedback provided to the archer of an index-finger-type archery release.

SUMMARY OF THE DISCLOSURE

Disclosed is an index-finger-type archery release having a release head, a hook or pawl pivotally mounted to the release head, and a trigger attached to a trigger holder that is also pivotally mounted to the release head.

The hook pivots between a grip position and a release position angularly spaced from the grip position. When the hook is in its grip position, the hook can capture and retain the bowstring while the archer is drawing the bowstring. The trigger holder pivots towards and away from the hook and can move between a locked position that resists movement of the hook from its grip position and an unlocked position spaced away from the hook that enables the hook to release the drawn bowstring.

When the hook is in the grip position, the trigger holder is in the path of pivotal movement of the hook towards the release position. The trigger holder when in the locked position obstructs and resists pivotal movement of the hook towards the release position. In this state the release head is "cocked" and can hold the bowstring while the archer is drawing the bowstring with the archery release.

After drawing the bowstring, the archer pulls on the trigger with the index finger to release the bowstring from the hook. Pulling the trigger pivots the trigger holder away from the hook from the locked position to the unlocked position. When in the unlocked position the trigger holder does not obstruct pivotal movement of the hook towards the hook's release position.

With the trigger holder out of the path of movement of the hook, the bowstring tension urges pivotal movement of the hook from the grip position towards the release position, thereby releasing the bowstring from the archery release After the bowstring is released, the archer lets go of the trigger. The trigger holder is urged to pivot towards the hook from the unlocked position and towards its locked position. Pivotal movement of the trigger holder may in fact go beyond the locked position and may be limited either by obstruction by the release head or by contact with the hook.

The archer then manually pivots the hook from the release position to the grip position. The trigger holder presses against and moves relatively along an outer surface of the hook during pivotal movement of the hook towards the grip position. In some embodiments there may be some lost motion of the hook before the outer surface of the hook engages the trigger holder. The outer surface may function as a camming surface that causes pivotal movement of the trigger holder and generating additional force urging the trigger holder towards the hook.

As the hook nears the grip position, the trigger holder engages or is received in an indentation or recess in the hook outer surface that enables the trigger holder to pivot to its locked position as the hook pivots to its grip position. The hook is back to its grip position and the trigger holder is back to its locked position in the path of the hook towards the release position. The archery release is again cocked and ready to draw the bowstring.

In possible embodiments the outer surface of the hook has a curved circumferential surface extending angularly away from the indentation. The curved surface acts as a cam surface controlling the deflection of the trigger holder as the hook moves from its release position to its grip position.

In embodiments the curved surface may have a surface portion having a constant radius of curvature. The center of curvature in possible embodiments may be offset from the hook pivot axis to enable the hook to dependably push against the trigger holder and generate more force urging the trigger holder to its locked position.

In other possible embodiments the center of curvature of the surface portion may be concentric with the pivot axis whereby the trigger holder remains stationary with respect to the release head while moving along the surface portion.

In other possible embodiments the trigger holder carries a roller bearing that contacts and rolls along the hook to reduce friction and further lower the torque necessary to return the hook back to its grip position In further embodiments the transition to the indented surface or the hook takes place as a sudden change of slope of the outer surface of the hook. The sudden change of slope results in a sudden pivotal movement of the trigger holder to its locked position. This sudden pivotal movement generates a "snap action" that provides strong feedback to the archer that the hook has returned to its grip position and the archery release is again cocked and ready for use.

Further, the sudden change in slope forms a radially extending abutment surface on the hook that presses against the trigger holder and reliably maintains the hook in its grip position when drawing the bowstring.

The disclosed archery release has a number of advantages. The trigger holder directly engages the hook without intermediate component parts, simplifying assembly. The motion of the trigger is transmitted directly to the trigger holder to release the hook and is not transmitted through intermediate springs or other members that can have play or looseness. The snap action of the trigger holder generated when the hook is manually pivoted back to its grip position after release provides strong, positive feedback to the archer that the archery release is again cocked and ready for use.

Other objects and features of the disclosure will become apparent as the description proceeds, especially when taken in conjunction with the accompanying drawing sheets illustrating one or more illustrative embodiments.

DETAILED DESCRIPTION

Figure 2:
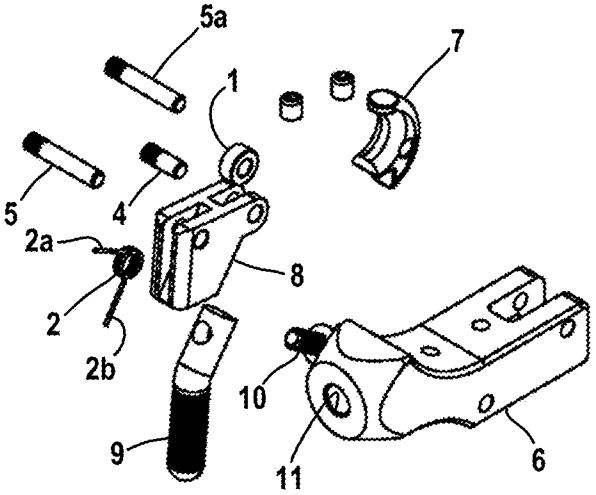
FIG. 2 is an exploded view of the archery release shown in FIG. 1.
Figure 1:
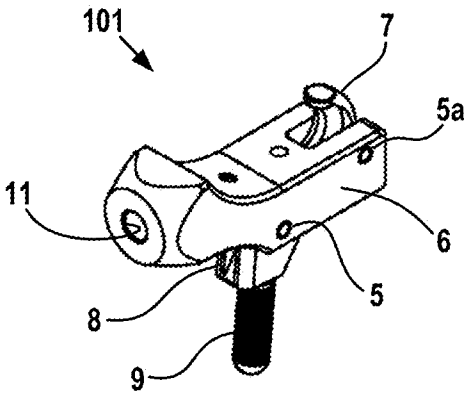
FIG. 1 illustrates a first embodiment archery release in accordance with this disclosure.

A first embodiment archery release 101 and its components are shown in FIGS. 1-10. As shown in FIGS. 1 and 2, the archery release 101 includes a pawl or hook 7, a release head 6, a trigger holder 8, and a trigger 9 attached to the trigger holder. FIG. 1 illustrates the assembled archery release 101. FIG. 2 is an exploded view of the archery release 101.

Figure 6:
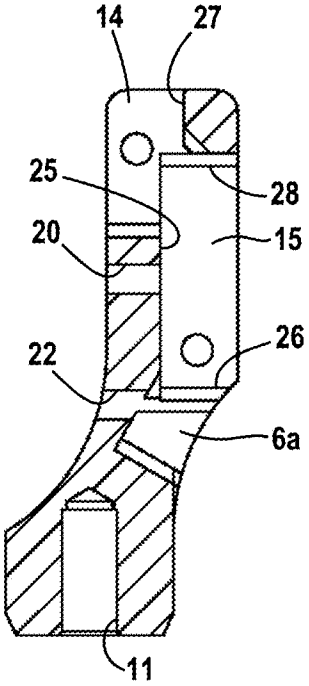
FIG. 6 is a sectional view taken along line B-B of FIG. 5.
Figure 5:
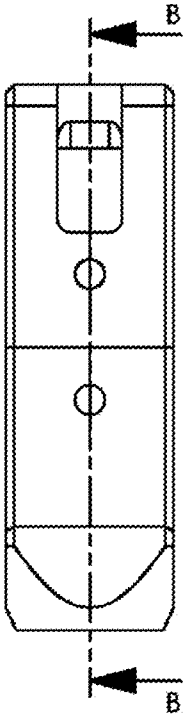
FIG. 5 is a front view of the release head shown in FIGS. 3 and 4.
Figure 4:
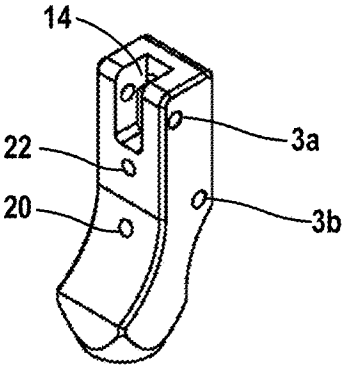
FIGS. 3 and 4 are opposed perspective views of the release head of the archery release shown in FIG. 1.
Figure 3:
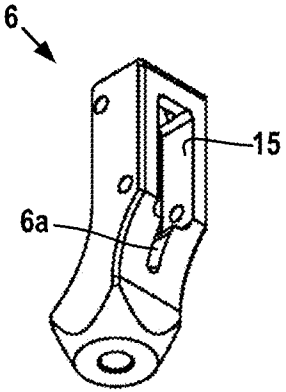
Figure 10:
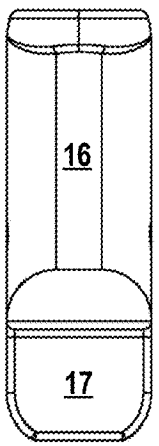
FIG. 10 is a front view of the hook shown in FIG. 8.
Figure 9:
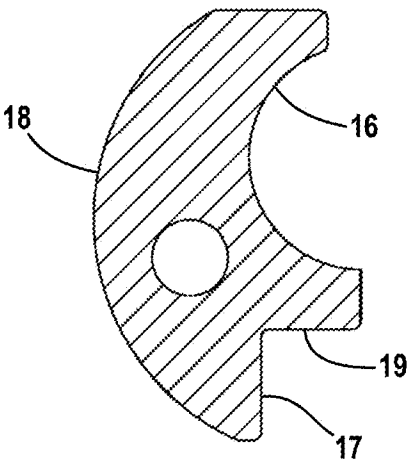
FIG. 9 is a sectional view taken along line A-A of FIG. 8.
Figure 8:
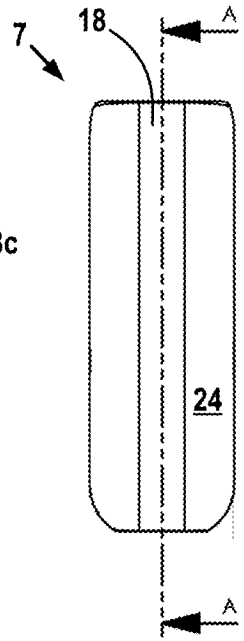
FIG. 8 is a back view of the hook of the archery release shown in FIG. 1.
Figure 7:
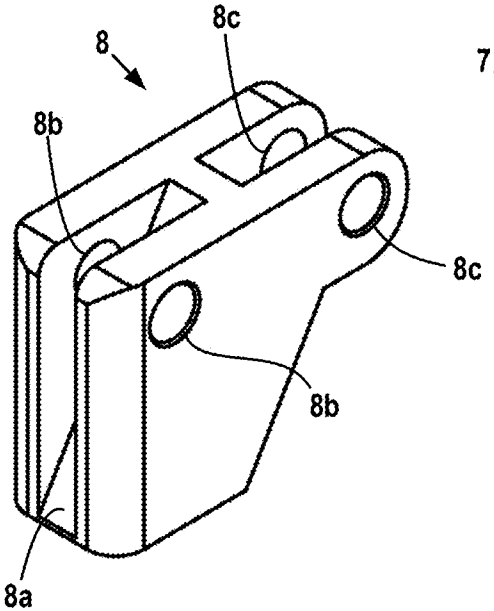
FIG. 7 is a perspective view of the trigger holder of the archery release shown in FIG. 1.

FIGS. 3-6 are views of the release head 6. FIG. 7 is of the trigger holder 8. FIGS. 8-10 illustrate the hook 7.

The hook 7 is pivotally mounted to the release head 6 in a release head opening 14 at one end of the release head 6 by a pin 5*a* that passes through a pair of aligned holes 3*a* in the release head 6. Clockwise pivotal movement of the hook as viewed in FIG. 6 is limited by the floor 27 of the opening 14. Counter-clockwise pivotal movement of the hook as viewed in FIG. 6 is limited by the front wall 28 of the slot 15 and defines the release position of the hook.

The trigger holder 8 is pivotally mounted in a release head slot 15 formed on the bottom side of the release head 6 by a pin 5 passing through an aligned pair of holes 3*b* in the release head 6 and a pair of aligned holes 8*b* in the trigger holder 8. The slot 15 has an upper wall 25 and a back wall 26. The upper wall 25 partially covers the slot and limits pivotal movement of the trigger holder in the counter-clockwise direction as viewed in FIG. 6. The back wall 26 limits pivotal movement of the trigger holder in the clockwise direction as viewed in FIG. 6.

The slot 15 opens into the hook opening 14 at one end of the release head. The opposite end of the release head includes a threaded blind hole 11 for attaching a strap, grip, or other device to the release heat that connects the release head to the archer during use.

The hook 7 includes a concave hook retention surface 16 on a first side of the hook. The retention surface 16 retains and holds the drawn bowstring. The other side of the hook 7 has an outer surface 24 that extends partially around the hook pivot axis and faces the trigger holder 8 when the hook is in the release position (see FIG. 12). The outer surface 24 includes a circularly shaped, constant radius outer surface portion 18 that extends to a flat surface portion 19 located radially inwardly from the hook pivot axis with respect to the immediately adjacent portion of the outer surface 18. The center of curvature of the outer surface portion is offset from the pivot axis of the hook whereby the radial distance of the outer surface from the pivot axis varies along the circumference of the surface.

The transition from the curved outer surface 18 to the indented flat surface 19 is essentially an instantaneous and substantial change in the slope of the outer surface that forms a generally flat surface 17 perpendicular to the indented surface 18.

The trigger holder 8 removably and rigidly mounts the trigger 9 to the trigger holder using a screw 10. The screw 10 extends through a hole in the trigger and threads into a threaded hole (not shown) in the trigger holder 8. Different types or shapes of triggers can be attached to the trigger holder 8 by the archer to meet individual needs and comfort.

The trigger holder 8 has a forward end that faces towards the hook 7 held in the release head 6 and carries a roller 1. The trigger holder roller 1 is rotatably mounted in the forward end of the trigger holder 8 by a pin 4 passing through a pair of aligned holes 8*c* formed in the trigger holder 8. The roller 1 has an outer circular surface extending outwardly beyond the forward end of the trigger holder.

A torsion spring 2 is a coiled spring body that fits over the pin 5. The torsion spring has elongate arms 2*a*, 2*b* at opposite ends of the spring body that press against the release head 6 and the trigger holder 8 respectively, the torsion spring encouraging the trigger holder 8 to pivot in a counter-clockwise direction about the pin 5 as viewed in FIG. 1. One spring arm 2*a* is received in a groove 6*a* of the release head and presses against the bottom surface of the groove. The other spring arm 2*b* presses against the surface 8*a* of the trigger holder.

The release head 6 includes a first threaded hole 22 that opens into the groove 6*a* and receives a set screw (not shown) to add or remove torque applied by the torsion spring 2 to the trigger holder 8. The release head includes a second threaded hole 20 that opens into the opening 15 and receives a set screw (see FIG. 12) that can extend outwardly from the release head wall 25 into the slot 15. The screw 29 when extending into the slot 15 forms an adjustable portion of the head wall 25 that engages the trigger holder and enables the archer to selectively limit pivotal movement of the trigger holder in the counter-clockwise direction as viewed in FIG. 6.

Figure 11:
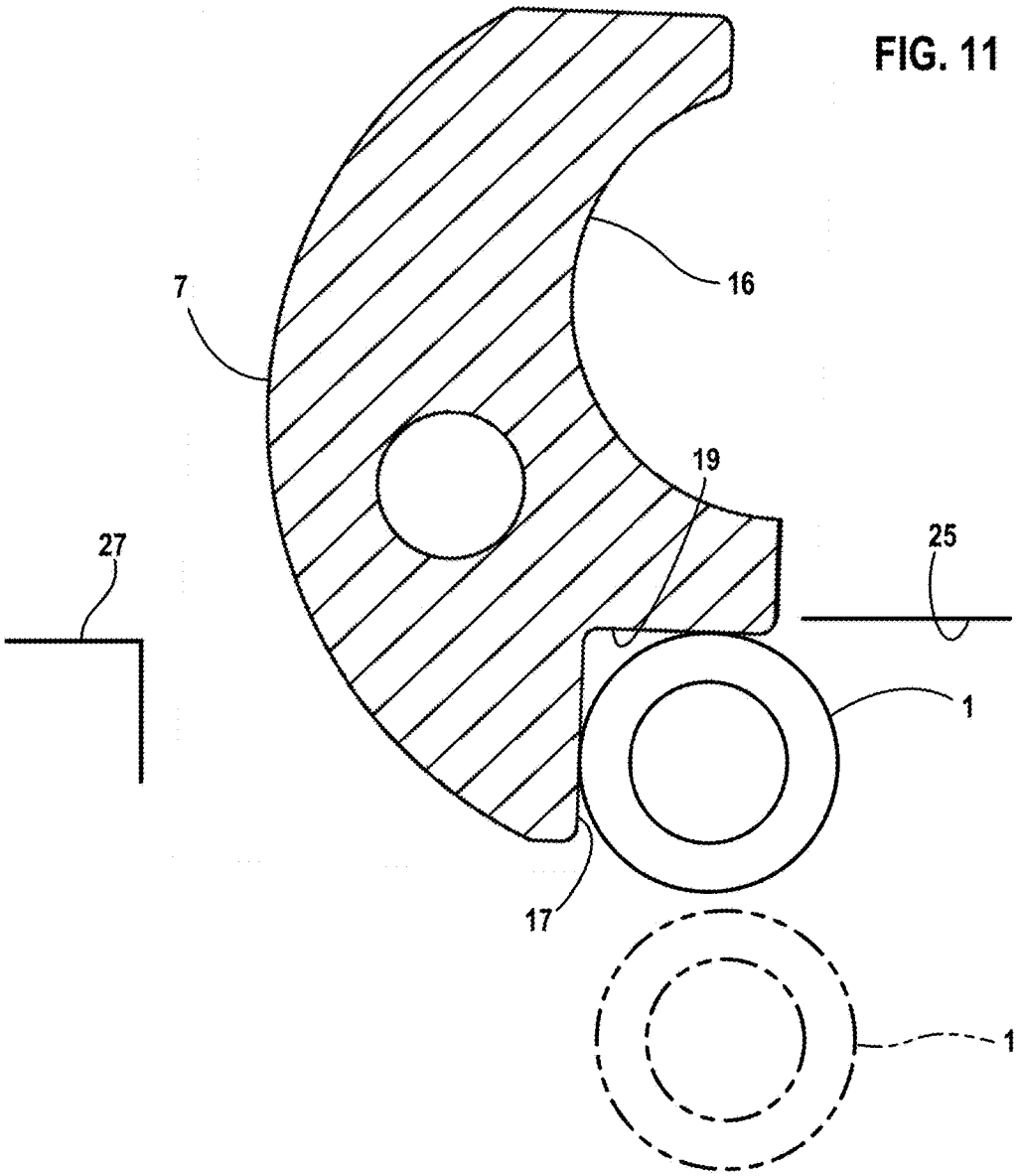
FIG. 11 illustrates the archery release with the hook in its grip position.

FIG. 11 illustrates the hook 7 in its grip position and the trigger holder in its locked position (to simplify the drawing only the trigger holder roller 1 is illustrated). The concave hook surface 16 extends outwardly from the release head and faces forward to receive and retain the bowstring (not shown). The roller 1 is being urged against the hook flat surface 19 as shown in FIG. 11 by the torsion spring 2. The hook is urged to rotate counter-clockwise as shown in FIG.

11, urging the abutment surface 17 against the roller 1 and effectively locking the hook in place in its grip position.

When drawing the bowstring with the hook 7 being held in its grip position in the release head 6, the bowstring attempts to rotate the hook 7 in a counter-clockwise direction about the pin 5*a* as viewed in FIG. 11. Pivotal movement of the hook 7 about the pin 5*a* while drawing the bowstring is resisted by the hook abutment surface 17 pressing against the roller 1.

When the bowstring being held by the hook 7 has been drawn to its desired position, the archer pulls on the trigger 9 with the index finger to release the bowstring. The trigger applies torque to the trigger holder 8 that overcomes the urging of the torsion spring 2 and pivots the trigger holder clockwise about the pin 5 as viewed in FIG. 11.

Actuating the trigger moves the roller 1 out of the path of pivotal movement of the hook abutment surface 17 and to the position shown in phantom lines in FIG. 11. The relatively short displacement of the roller 1 enables a short trigger pull to unlock the hook and release the bowstring from the archery release.

Figure 12:
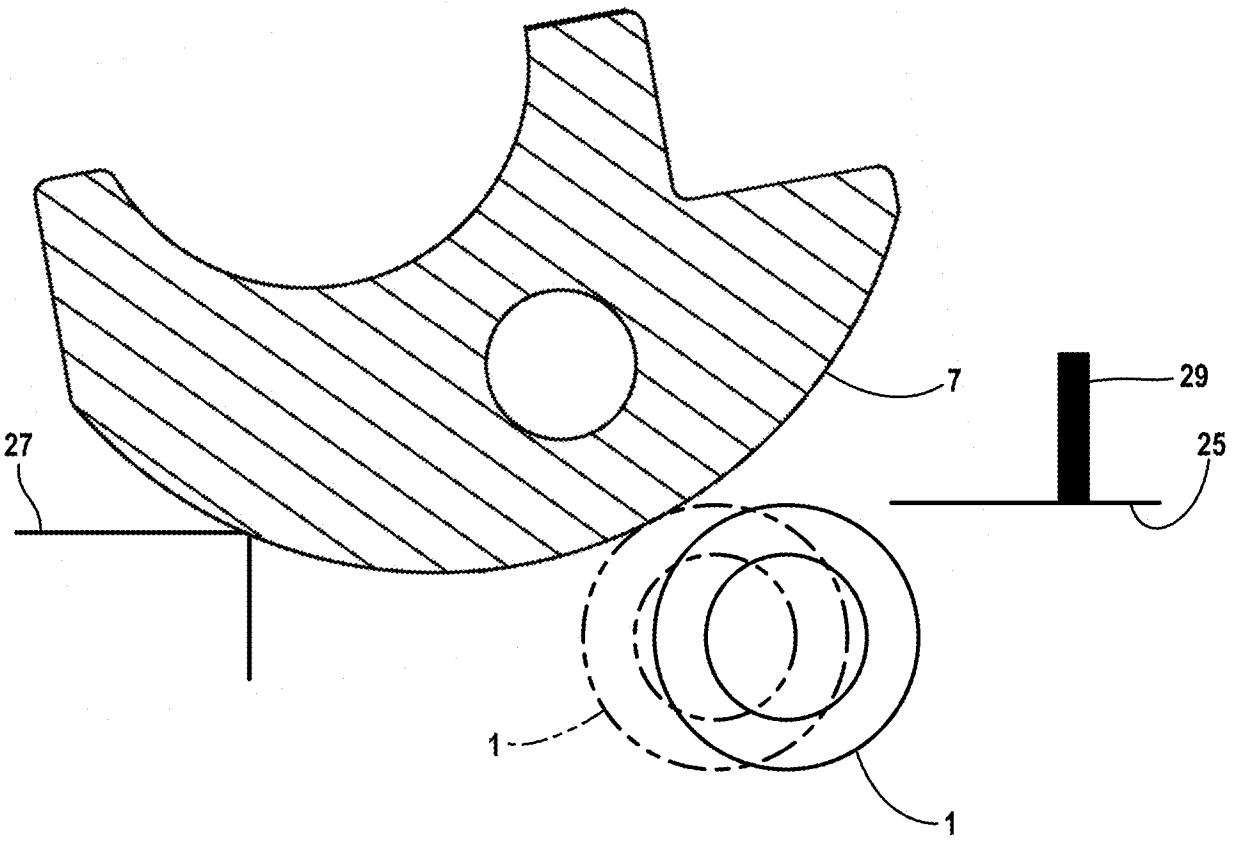
FIG. 12 is similar to FIG. 11 but with the hook pivoted from its grip position to its release position.

The bowstring tension is then free to pivot the hook 7 about the pivot pin 5*a* counter-clockwise as viewed in FIG. 11 to the release position of the hook 7 shown in FIG. 12. Continued pivotal movement of the hook is obstructed by the release head wall 27. The pivotal displacement of the hook releases the bowstring from the hook retention surface 16.

After releasing the bowstring, the archer removes the trigger finger from the trigger 9. The torsion spring 2 urges the trigger holder 8 to pivot counter-clockwise about the pivot pin 5 until obstructed by the release head wall 25. FIG. 12 illustrates the position of the roller 1 relative to the hook 7 after release of the trigger. In the illustrated embodiment the roller 1 is spaced away from the hook 7 when the trigger holder is obstructed by the set screw 29. The set screw 29 is used by the archer in FIG. 12 to establish the "height" of the release head wall 25 and the return position of the trigger holder.

Figure 13:
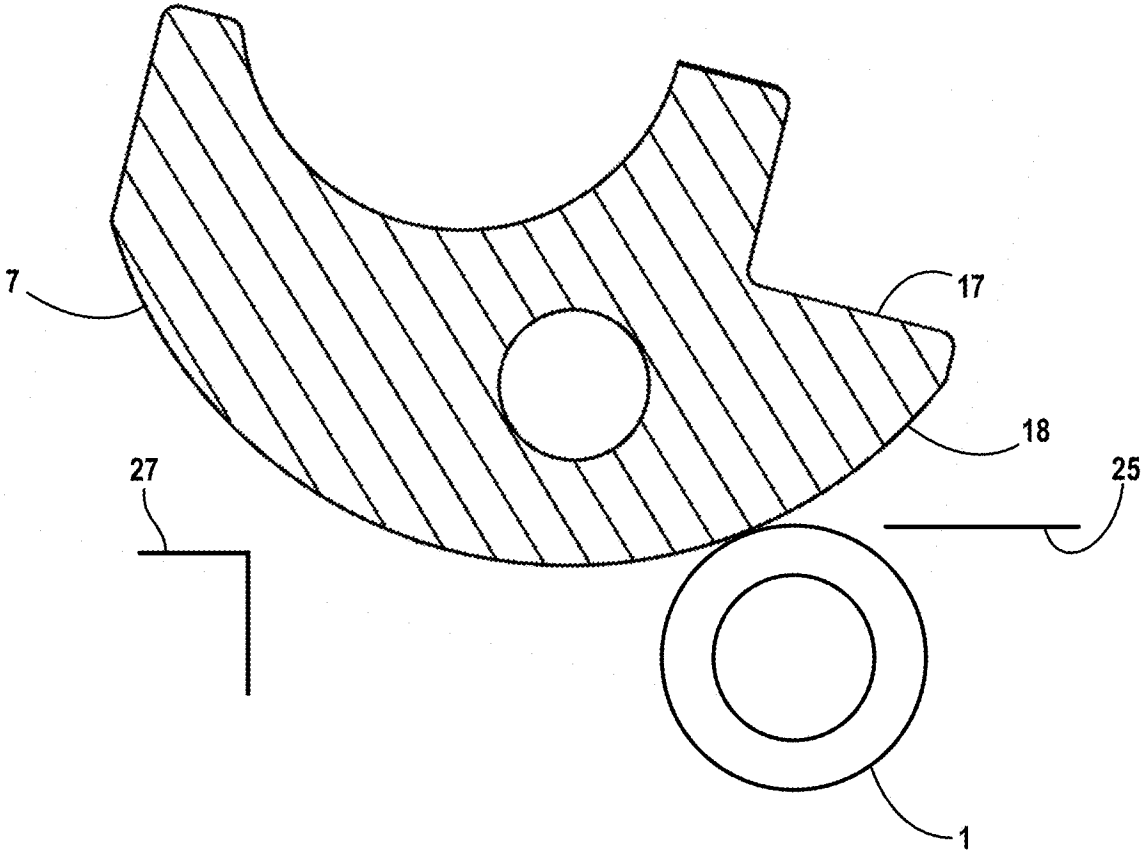
FIG. 13 is similar to FIG. 12 but with the hook pivoted partway from its release position to its grip position.

The archer next pivots the hook 7 manually clockwise about the pin 5*a* as viewed in FIG. 12 to re-cock the archery release. As shown in FIG. 13, pivoting the hook back towards its grip position brings the hook into initial contact with the curved outer surface of the roller 1. Continued pivotal movement of the hook causes the roller 1 to function as a cam follower on the cam surface defined by the outer surface of the hook. In the illustrated embodiment there is some lost motion of the hook as the hook moves from its angular position shown in FIG. 11 to its angular position shown in FIG. 12 before engaging the roller 1. The lost motion is not detrimental since it does not hinder manual pivoting of the hook by the archer.

In other possible embodiments of the archery release the hook and trigger holder can be cooperatively designed whereby the roller 1 can engage the hook upon release of the trigger as shown in phantom lines in FIG. 12, thereby eliminating lost motion.

Continual pivotal displacement of the hook from its FIG. 13 position back to its FIG. 11 position maintains the roller 1 against the hook outer surface portion 18. The roller 1 functions as a contact nose providing rolling contact of the trigger holder against the hook. In other embodiments the trigger holder can have a fixed or stationary contact nose that is configured to slide along the outer surface of the hook.

The radial offset of the curvature of the curved back surface portion 18 with respect to the hook pivot axis causes the hook to angularly deflect the roller 1 and thus the trigger holder 8 in a counter-clockwise direction away from the release head wall 25 as the hook pivots towards its grip position. The angular deflection of the release head further compresses and loads the torsion spring 2 to assure adequate spring force to move the trigger holder back into its locked position when the hook reaches its grip position.

In other embodiments the contour of the outer surface portion can have different camming profiles to achieve the desired loading or rate of loading of the spring 2. In possible embodiments portions of the outer surface 18 can include a circular portion concentric with the hook pivot axis to maintain a constant spring preload and maintain the trigger holder stationary with respect to the release head while the trigger holder is against the concentric surface portion.

When the relative angular displacement of the roller 1 with respect to the curved surface 18 of the hook 7 passes over the abutment surface 17. The sudden change in slope causes the torsion spring 2 to urge pivotal movement of the trigger holder 8 towards the hook 7 and against the flat hook surface 19, returning the archery release back to its cocked state shown in FIG. 11.

With the hook 7 returned to its grip position and the trigger holder 8 returned to its locked position, the roller 1 has moved back into the path of pivotal movement of the hook 7 towards the release position and resists pivotal movement of the abutment surface 17.

The sudden angular displacement of the trigger holder 8 and resulting sudden placement of the roller 1 into the path of the abutment surface 17 generates a "snap action" that signals to the archer that the archery release is again cocked and ready for use.

Figure 15:
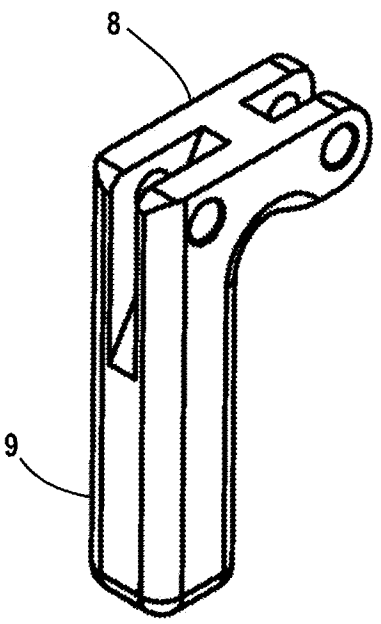
FIG. 15 illustrates the trigger holder and integral trigger of the archery release shown in FIG. 14.
Figure 14:
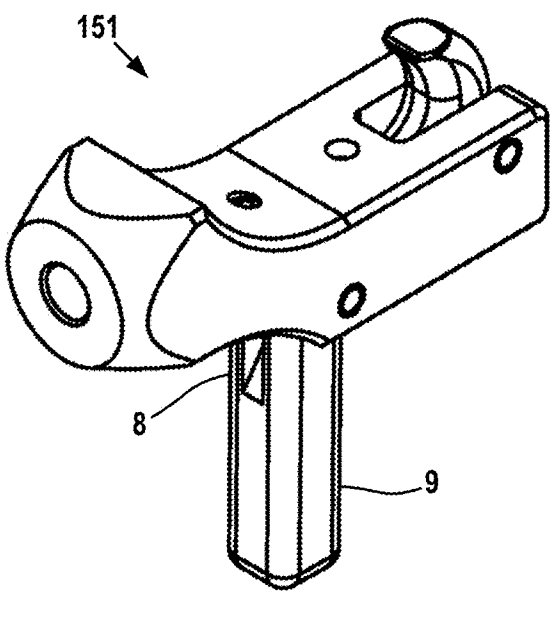
FIG. 14 illustrates a second embodiment archery release in accordance with this disclosure.

FIGS. 14 and 15 illustrate a second embodiment archery release 151 otherwise identical to the archery release 101 but for the trigger 9 being integrally formed with the trigger holder 8. The trigger is not intended to be interchangeable with other triggers and is integrally formed with the trigger holder to form a one-piece, homogenous, integral member.

Figure 16:
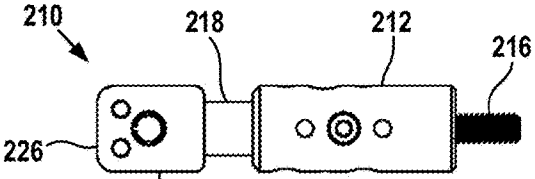
FIG. 16 is a side view of a grip usable with the archery releases shown in FIGS. 1 and 14.
Figure 17:
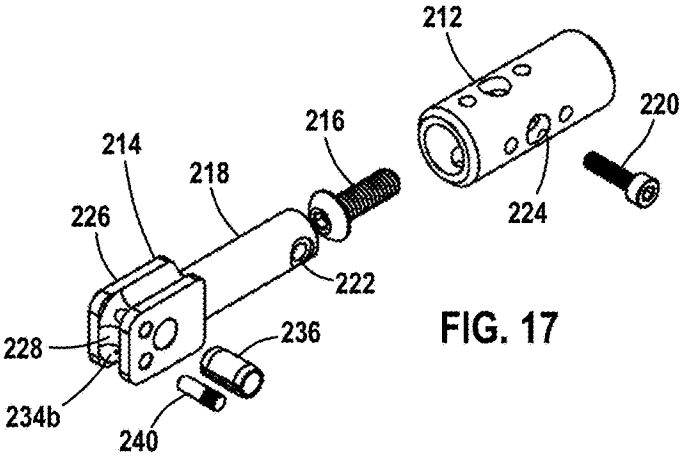
FIG. 17 is an exploded view of the grip shown in FIG. 16.

The release head threaded hole 11 attaches a strap, grip, or other device to the release head. FIGS. 16 and 17 illustrate a grip 210 that can be used with the disclosed archery release. The illustrated grip includes a tubular module 212 on one end of the grip and a stud 214 on the other end of the grip. A threaded screw 216 extends away from the module 212 and is threaded into the release head hole 11 to attach the grip 210 to the archery release.

The stud 214 is configured to hold and orient a wire coil spring in three different orientations with respect to the stud as will be illustrated in more detail below. The coil spring can carry a wrist band, arm band, or similar attachment device that attaches to the archer during use of the archery release.

The stud 214 includes a shaft 218 that is received into the module 212. A screw 220 passes through aligned pairs of holes 222, 224 in the stud and the module respectively to fix the stud in the module. The stud shaft extends axially away from the module to an opposite end portion 226 of the stud that carries the coil spring.

Figure 19:
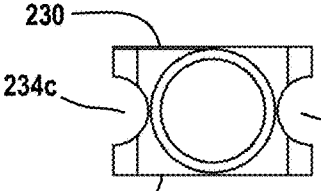
FIGS. 18 and 19 are perspective and end views respectively of the stud forming a portion of the grip shown in FIG. 16.
Figure 18:
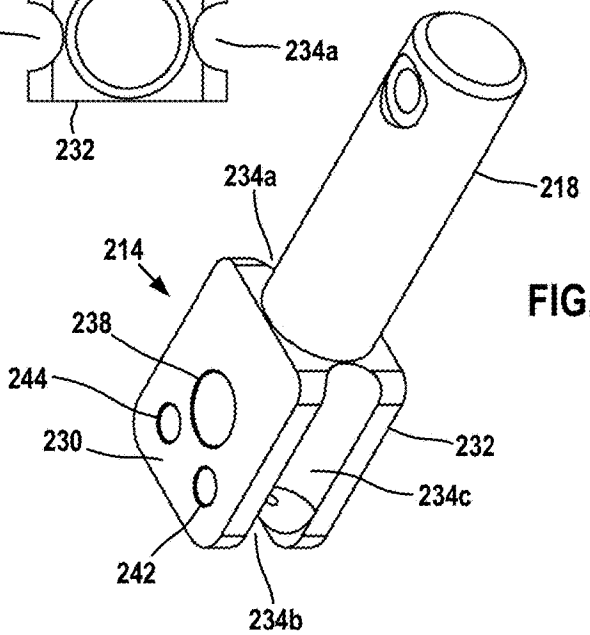

The stud 214 is shown in FIGS. 18 and 19. The end portion 226 includes a central generally rectangular plate 228 (see FIG. 15) that extends from the stud shaft 218 and is disposed between a centered pair of larger rectangular plates 230, 232. The three plates cooperate with one another to define three rounded channels 234*a*, 234*b*, 234*c* extending around three sides of the central plate 228.

A roll pin 236 (see FIG. 15) having a through-bore extends through a bore 238 extending through the center of the plates 228, 230, 232. A pair of pins 240 (one of which is shown in FIG. 15) extend through respective pairs of aligned through holes 242, 244 formed in the plates 230, 232 in a direction transverse to the shaft axis and near the intersection of the ends of the channel 234*b* and respective channels 234*a*, 234*c*.

FIGS. 22 and 23 illustrate the cross arm received in the channel 234*b*. Initial rotation of the coil spring in the roll pin 236 to move the cross arm 314 out of the channel 234*a* increases the displacement of the cross arm away from the spring coil and resists rotation. Once the cross arm passes the corner of the plate 228 defining the intersection of the channels 234*a*, 234*b*, the displacement of the cross arm away from the spring coil begins to decrease, creating a "snap over center" effect that urges continued rotation of the coil spring until the cross arm is received into the channel 234*b*.

In other possible embodiments of the grip, the plate 228 may be pentagonal, hexagonal, or have even more polygon sides.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, operating ranges (hook or trigger holder displacement for example), and the like, as well as such changes and alterations that fall within the purview of the following claims.

What is claimed is:

1. An archery release for drawing and then releasing a bowstring by an archer, the archery release comprising:

a release head, a trigger holder, a hook, a trigger attached to the trigger holder, and a spring;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the spring being attached to the release head, the spring being disposed to transmit a force to the trigger holder urging the trigger holder towards the locked position of the trigger holder; and the spring being a torsion spring disposed between the release head and the trigger holder, the torsion spring being disposed to apply a force to the trigger holder urging angular deflection of the trigger holder away from its unlocked position.

2. An archery release for drawing and then releasing a bowstring by an archer, the archery release comprising:

a release head, a trigger holder, a hook, and a trigger attached to the trigger holder;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the hook comprising an outer abutment surface that abuts against the trigger holder when the hook is in its grip position and the trigger holder is in its locked position, the trigger holder obstructing pivotal movement of the abutment surface towards the release position of the hook; and the trigger holder abutting against a second outer surface of the hook when the hook is in the grip position and the trigger holder in its locked position.

3. The archery release of claim 2 wherein the trigger holder transfers a force to the second outer surface of the hook urging the hook to pivot towards its release position and thereby urging the abutment surface against the trigger holder.

4. The archery release of claim 2 wherein the hook comprises a third outer surface extending adjacent from the outer abutment surface partially around the first pivot axis in an angular direction away from the second outer surface, the outer abutment surface being transverse to the third outer surface where the third outer abutment surface is adjacent to the outer abutment surface.

5. The archery release of claim 4 wherein the third outer surface has a constant radius of curvature extending from a center of curvature.

6. The archery release of claim 5 wherein the center of curvature of the third outer surface is spaced away from the first pivot axis.

7. The archery release of claim 2 wherein the outer abutment surface is perpendicular to the second outer surface.

8. The archery release of claim 2 wherein the trigger holder is urged away from its unlocked position towards its locked position when the trigger is released after actuation;

pivotal motion of the hook from its release position to its grip position after the trigger is released engages the trigger holder against an outer surface of the hook for at least a portion of the movement of the hook from its release position to its grip position, the outer surface deflecting the trigger holder towards its unlocked position and away from its locked position before the hook reaches its grip position.

9. The archery release of claim 2 wherein the trigger holder comprises a roller that engages the outer abutment surface and the second outer surface of the hook when the hook is in the grip position and the trigger holder is in the locked position.

10. The archery release of claim 9 wherein the outer abutment surface is perpendicular to the second outer surface.

11. The archery release of claim 2 wherein when the hook is in its grip position and the trigger holder is in its locked position, the hook is being urged to rotate in a first direction about the first pivot axis and the trigger holder is being urged to rotate in a second direction about the second pivot axis, the hook and the trigger holder mutually obstructing continued rotation of the hook and trigger holder in the first and second directions of rotation respectively whereby the archery release is in a cocked state with the hook and the trigger holder in their respective positions and stationary with respect to one another.

12. The archery release of claim 2 wherein the first pivot axis and the second pivot axis are spaced a distance apart from one another, the distance between the first and second pivot axes enabling the trigger holder when in its release position to be in the path of at least part of rotational movement of the hook about the first pivot axis from the release position of the hook to the grip position of the hook.

13. An archery release for drawing and then releasing a bowstring by an archer, the archery release comprising:

a release head, a trigger holder, a hook, and a trigger attached to the trigger holder;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the trigger holder being urged away from its unlocked position towards its locked position when the trigger is released after actuation;

pivotal motion of the hook from its release position to its grip position after the trigger is released engages the trigger holder against an outer surface of the hook for at least a portion of the movement of the hook from its release position to its grip position, the outer surface deflecting the trigger holder towards its unlocked position and away from its locked position before the hook reaches its grip position; and the trigger holder being against the hook when the trigger is released and the hook is in its released position.

14. An archery release for drawing and then releasing a bowstring by an archer, the archery release comprising:

a release head, a trigger holder, a hook, and a trigger attached to the trigger holder;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the trigger holder being urged away from its unlocked position towards its locked position when the trigger is released after actuation;

pivotal motion of the hook from its release position to its grip position after the trigger is released engages the trigger holder against an outer surface of the hook for at least a portion of the movement of the hook from its release position to its grip position, the outer surface deflecting the trigger holder towards its unlocked position and away from its locked position before the hook reaches its grip position; and the trigger holder comprising a roller that engages the outer surface of the hook and makes rolling contact with the outer surface of the hook.

15. An archery release for drawing and then releasing a bowstring by an archer, the archery release comprising:

a release head, a trigger holder, a hook, a trigger attached to the trigger holder, and a spring;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the trigger holder being urged away from its unlocked position towards its locked position when the trigger is released after actuation;

pivotal motion of the hook from its release position to its grip position after the trigger is released engages the trigger holder against an outer surface of the hook for at least a portion of the movement of the hook from its release position to its grip position, the outer surface deflecting the trigger holder towards its unlocked position and away from its locked position before the hook reaches its grip position;

the spring applying a force to the trigger holder urging the trigger holder away from its unlocked position whereby the deflection of the trigger holder towards its unlocked position increases the force; and the outer surface of the hook having a sudden discontinuous change in slope that generates a snap action of the trigger holder when the spring urges the trigger holder to its locked position.

16. An archery release for drawing and then releasing a bowstring by an archer, the archery release comprising:

a release head, a trigger holder, a hook, and a trigger attached to the trigger holder;

the hook being pivotally mounted to the release head, the hook being pivotally movable with respect to the release head about a first pivot axis, the hook being pivotally movable between a grip position and a release position spaced from the grip position, the hook being configured to receive and draw a bowstring when the hook is in the grip position wherein a drawn bowstring urges the hook towards the release position of the hook;

the trigger holder being pivotally mounted to the release head, the trigger holder being pivotally movable with respect to the release head about a second pivot axis towards and away from the hook, the trigger holder being pivotally movable between a locked position and an unlocked position spaced from the locked position;

the trigger extending away from the release head and being configured to be actuatable by an index finger of the archer to move the trigger holder from the locked position of the trigger holder to the unlocked position of the trigger holder;

the trigger holder being in the path of movement of the hook from the grip position towards the release position when the trigger holder is in the locked position and the hook is in the grip position;

the trigger holder not being in the path of movement of the hook from the grip position towards the release position when the trigger holder is in the unlocked position;

the trigger holder being urged away from its unlocked position towards its locked position when the trigger is released after actuation;

pivotal motion of the hook from its release position to its grip position after the trigger is released engages the trigger holder against an outer surface of the hook for at least a portion of the movement of the hook from its release position to its grip position, the outer surface deflecting the trigger holder towards its unlocked position and away from its locked position before the hook reaches its grip position;

the spring applying a force to the trigger holder urging the trigger holder away from its unlocked position whereby the deflection of the trigger holder towards its unlocked position increases the force; and the spring being a torsion spring disposed between the release head and the trigger holder, the torsion spring applying a torque to the trigger holder urging the trigger holder to pivot about the second pivot axis away from the locked position of the trigger holder, the torsion spring being the only spring of the release head.

* * * * *